US007645165B2

(12) United States Patent
Wu et al.

(10) Patent No.: US 7,645,165 B2
(45) Date of Patent: Jan. 12, 2010

(54) ELECTRICAL CONNECTOR WITH IMPROVED SHIELDING SHELL

(75) Inventors: Jian-Feng Wu, Kunshan (CN); Yong Luo, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/381,799

(22) Filed: Mar. 17, 2009

(65) Prior Publication Data

US 2009/0233484 A1 Sep. 17, 2009

(30) Foreign Application Priority Data

Mar. 17, 2008 (CN) ..... 2008 2 0032172 U
Mar. 25, 2008 (CN) ..... 2008 2 0033109 U

(51) Int. Cl.
*H01R 13/648* (2006.01)

(52) U.S. Cl. ..... 439/607.38; 439/607.4

(58) Field of Classification Search ..... 439/607.38, 439/607.4, 607.26, 607.54
See application file for complete search history.

(56) References Cited

U.S. PATENT DOCUMENTS

| | | | | |
|---|---|---|---|---|
| 5,637,014 | A * | 6/1997 | Sukegawa et al. | 439/607.4 |
| 6,319,062 | B1 * | 11/2001 | Ma et al. | 439/607.38 |
| 6,957,984 | B1 | 10/2005 | Huang | |
| 7,252,549 | B2 * | 8/2007 | Nishio et al. | 439/607.55 |
| 2004/0157491 | A1 * | 8/2004 | Lin | 439/607 |

* cited by examiner

*Primary Examiner*—Hien Vu
(74) *Attorney, Agent, or Firm*—Andrew C. Cheng; Wei Te Chung; Ming Chieh Chang

(57) ABSTRACT

An electrical connector includes an insulating housing having a pair of side-walls, a plurality of terminals retained in the insulating housing and comprising contacting portions and a shielding shell surrounding the housing. Each of the side walls of the housing defines a window portion thereof to communicating with the mating cavity and an exterior. A pair of side walls of the shell covers on the side walls of the insulating housing and each defines a resilient arm extending into the mating cavity through the window portion.

4 Claims, 4 Drawing Sheets

ELECTRICAL CONNECTOR WITH IMPROVED SHIELDING SHELL

BACKGROUND OF THE INVENTION

1. Field of the invention

The present invention generally relates to an electrical connector, and more particularly to an audio jack having a clip member for fitly retaining an audio plug.

2. Description of Related Art

Modular jacks, such as RJ 45 and RJ 11 are widely used in communication industry, each includes an insulating housing, a metal shell covered on a periphery of the housing and a plurality of terminals in the housing. A pair of resilient arm of the shell bend from front edges of two sidewalls thereof into a mating cavity through a front opening, which will be urged outward-movement by insertion a mating connector to function grounding. However, the conventional modular jack don't meet miniaturization tendency today.

Therefore, an improved electrical connector is desired to overcome the disadvantages of the related arts.

SUMMARY OF THE INVENTION

According to the present invention, an electrical connector comprises an insulating housing defining a mating cavity opening forwards and comprising a pair of sidewalls, each of the side walls defines a window portion thereof to communicating with the mating cavity and an exterior; a plurality of terminals retained in the insulating housing and comprising contacting portions projecting into the cavity; and a shielding shell surrounding the housing and comprising a pair of side wall covering on the side walls of the insulating housing. Each of the side walls of the shielding shell defines a resilient arm extending into the mating cavity through the window portion.

Other objects, advantages and novel features of the present invention will become more apparent from the following detailed description of the present embodiment when taken in conjunction with the accompanying drawings.

DETAILED DESCRIPTION OF THE INVENTION

Figure 1:
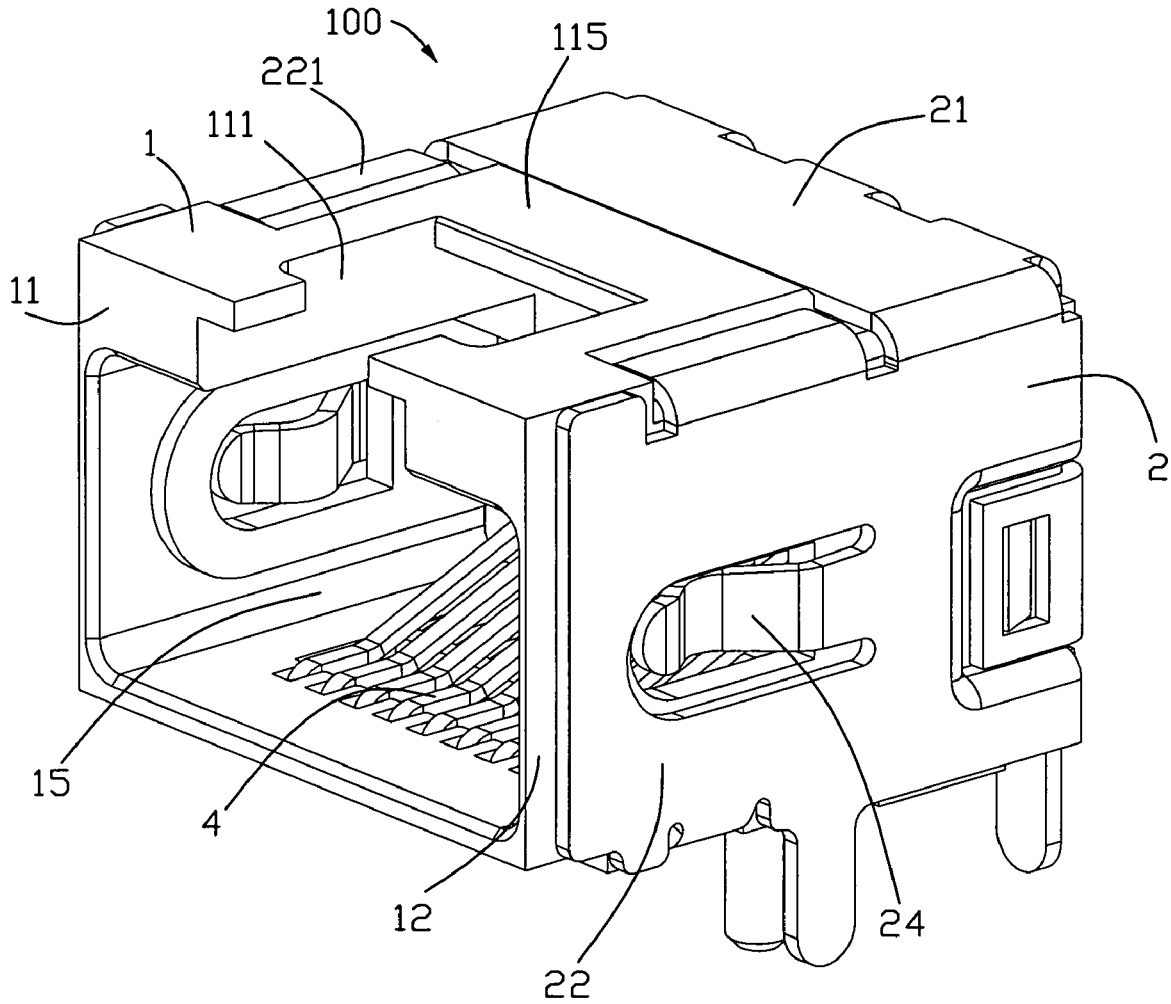
FIG. 1 is a top perspective view of an electrical connector according to the present invention.

Reference will now be made to the drawing figures to describe the preferred embodiment of the present invention in detail.

Referring to FIG. 1, an electrical connector 100, preferably a RJ 45, include an insulating housing 1, terminals 4 and a metallic shielding shell 2 covered on a periphery of the housing. A pair of resilient arm 24 of the shell protrude into a mating cavity 15 of the housing and a top wall 21 of the shell 2 partly cover a top of the housing and flushes with the other portion of the housing, which meet a miniaturization connector. Description will be made hereinafter.

Figure 2:
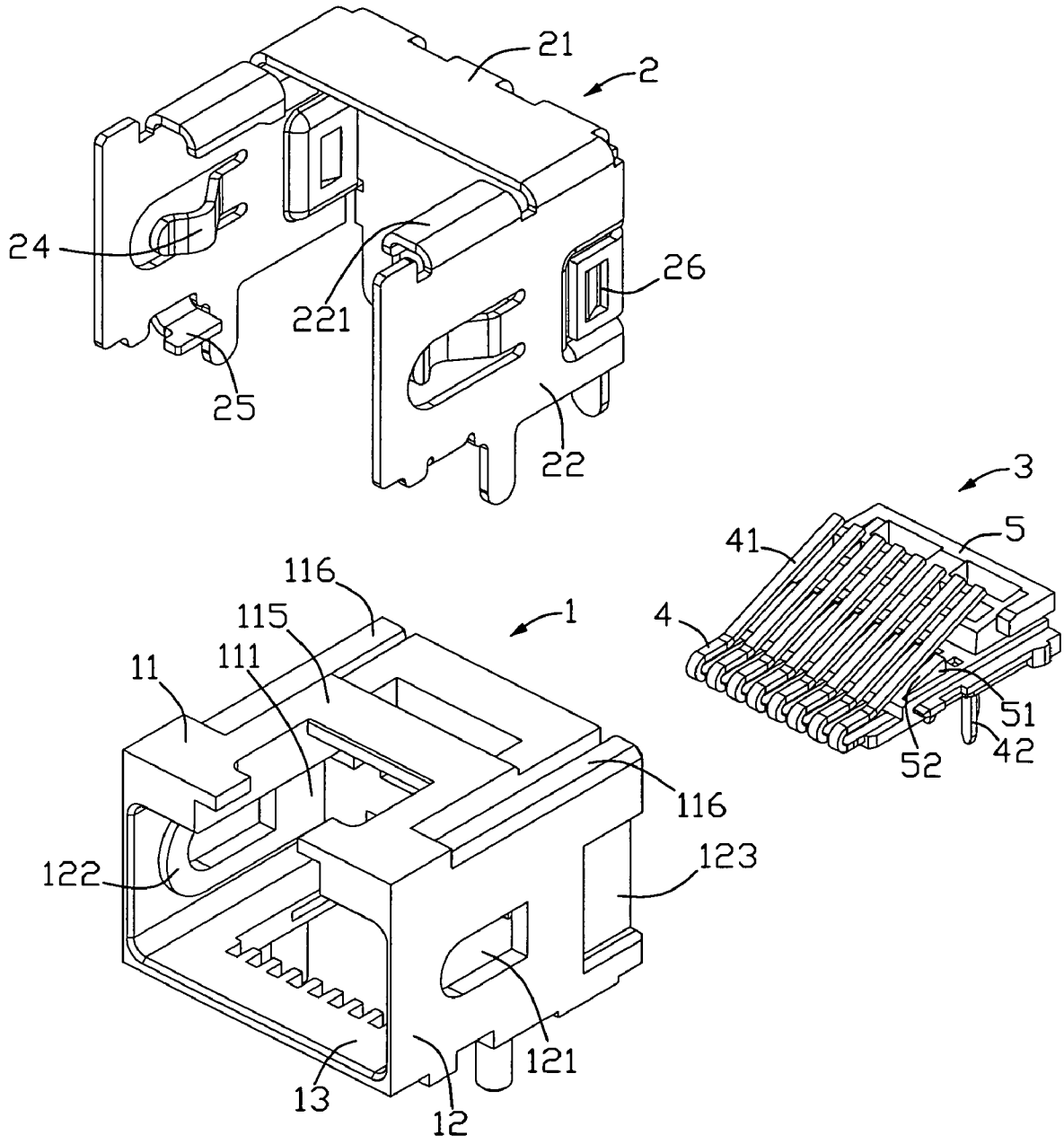
FIG. 2 is an exploded perspective view of the electrical connector shown in FIG. 1.
Figure 3:
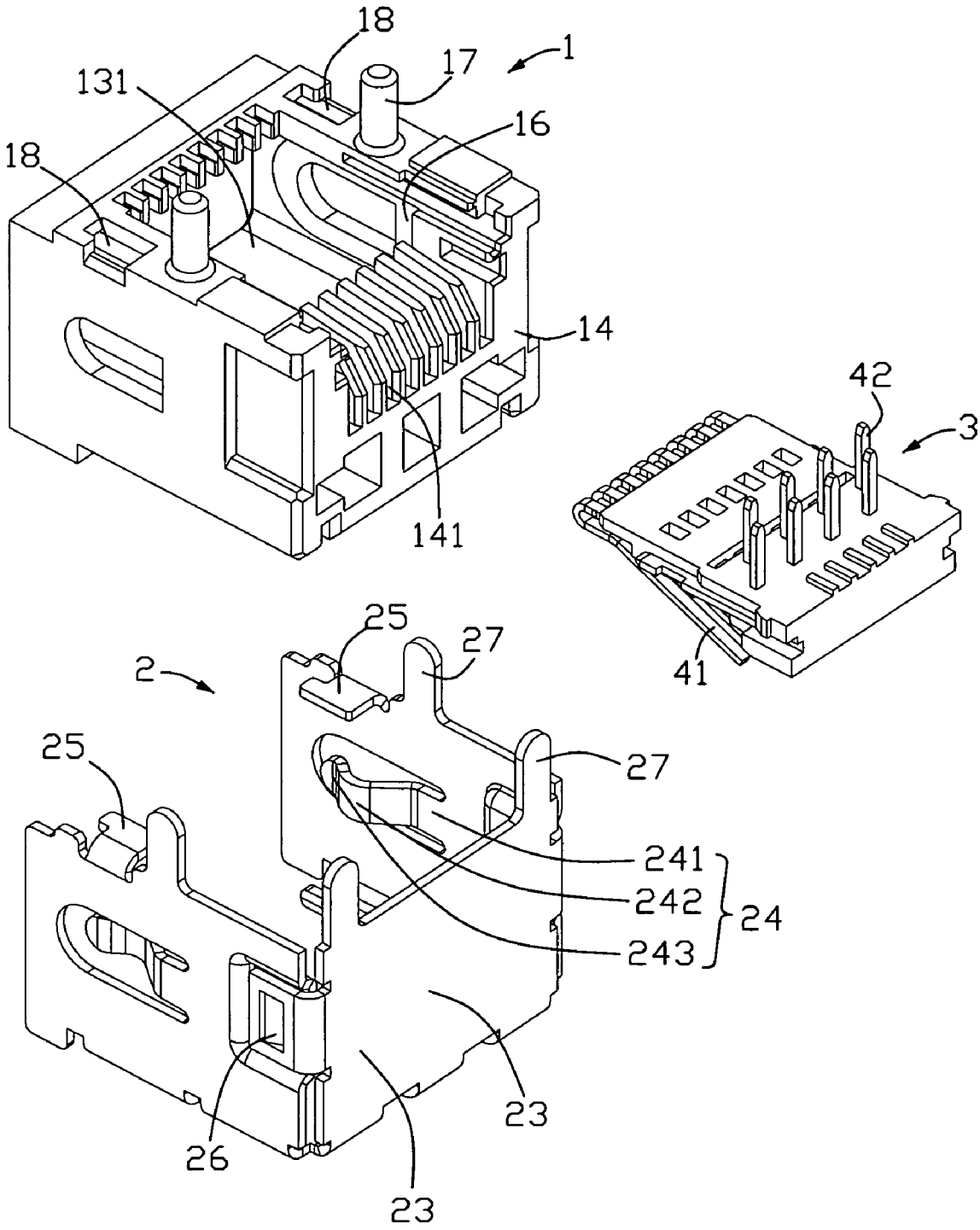
FIG. 3 is an exploded perspective view of the electrical connector from a bottom view.
Figure 4:
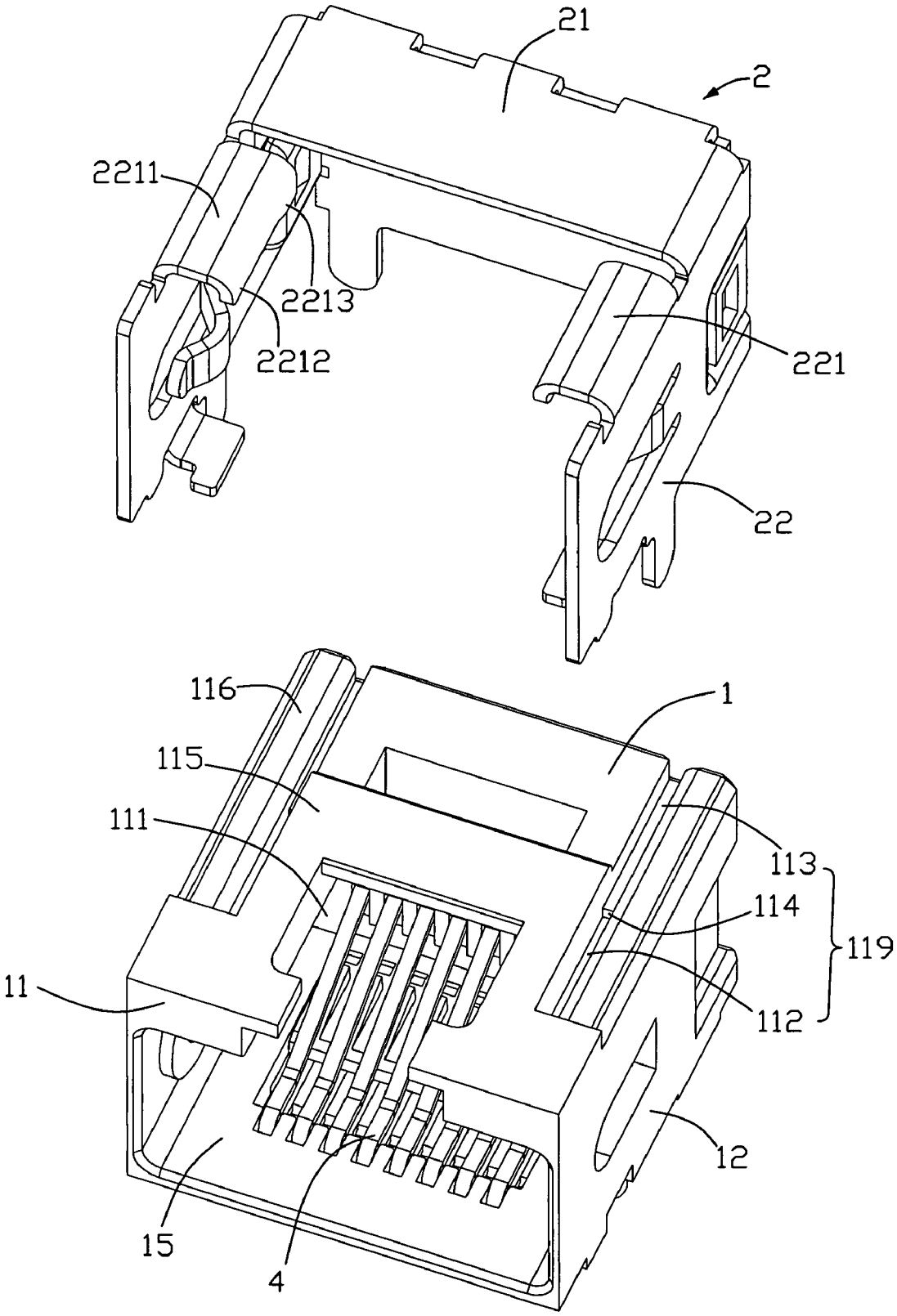
FIG. 4 is an exploded perspective view of the electrical connector shown in FIG. 1

Referring to FIGS. 1 and 2, the housing 1 of a rectangular configuration includes a pair of side walls 12, a top wall 11 and a bottom wall 13 commonly defining said mating cavity 15 with a front opening. Combination with FIG. 3, the bottom wall 13 has a larger though hole 131 to receive and retained a terminal module 3. The terminals 4 are embedded in an insulating body 5 to form said terminal module 3, the contacting portion 41 of the terminals slantwise bend upward and inward into the mating cavity 15 and the leg 42 downward exposed out of the bottom wall 13. A row of rib portion 51 with slant faces 52 on a top of the insulating body 5 are just adjacent with the contacting portions 41 to prevent the contacting portion from overly-downward shift.

The top wall 11 of the housing defines a channel 111 forwards running therethrough to engage a latch of a mating connector (not labeled). The outside face or top face of top wall 11 are of step configuration, a first portion 115 being in the front thereof and a second portion 116 adjacent to the back thereof. The first portion 115 is higher than the second portion 116, i.e. the second portion 116 is formed by the top wall 11 being recessed downward. Each side walls 12 of the housing define a window portion 121 and the inside of the sidewall around the window portion 121 are thickened thereby forming a boss portion 122. The shell 2 includes a pair of sidewall 22 and a top wall 21 connecting with the pair of the sidewall 22, wherein the top wall 22 only has a half portion compared with the sidewall, i.e. the top portion 21 are set on the second portion 116 of the top face of the insulating housing. Each of the side walls 22 of the shell 2 defines a resilient arm 24 formed by punching thereof at a position corresponding to the window portion 121.

The resilient arms 24 extend parallel and forwards from a joint where the resilient arm 24 unitarily connects with the side wall 22 of the shell 2, and includes a root portion 241 and an inward-arc portion 242 with a free end 243 along the extending direction thereof. The root portion 241 abut against the side wall 12 of the housing, the arc portion 242 go across the window portion 121 with a tip protruding into the mating cavity 10. The free end 243 bend outwards thereby the free end is hide in the window portion 121, so that the mating connector can be guided into the mating cavity 15. Since the resilient arms 24 separate from the housing, the thickness of the side wall 12 of the housing can become smaller as possible, especially in a mating process of the connector being inserted with a mating connector the side wall of the housing will not be destroyed.

A retaining portion 25 of the bottom edge of each side wall 22 of the shell 2 bends inwards to be retained in a groove 18 at the bottom o the side wall of the housing. A pair of retaining pieces 26 bend forwards from a rear wall 23 of the shell to locking with the side wall 22 of the shell 2 at a rear position of the resilient arm 24. Four soldering legs 27 extend downwards from the bottom edges of the shell 2.

The shell defines a pair of locking portions 221 bending inwards and downwards to be retained in corresponding slots 119 defined on the second portion 116 of the top face of the housing 2. The locking portions 221 are in front of the top wall 21 of the shell and includes a parallel linking portion 2211 and a upright retaining portion 2212 with a downwards-projecting tab 2213 adjacent to the top wall 21. The slot 119 of linear includes a first slot 113 and a second slot 112 in front of the first slot. The first slot runs through a rear face of the housing and is shallower than the second slot, thereby a stop face 114 is formed. When the shell 2 is assembled from a rear-to-front direction, the retaining portions 2212 move forwards from the first slot 113 and then to the second slot 112, and finally are located in the second slot 112 limited by the stop face 114. The downwards-projecting tab 2213 benefits the interference of the retaining portions 2212 and the insides of the slots 112.

The top wall 22 of the shell cover on a rear portion of the top face of housing and the channel 111 are communicating with an exterior without any covering shell. The top wall 21 of the shell and the top wall of the housing complete a top face of the connector 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing defining a mating cavity opening forwards and comprising a pair of sidewalls, each of the side walls defining a boss portion surrounding an interior face of a window portion to communicate with the mating cavity and an exterior;

a plurality of terminals retained in the insulating housing and comprising contacting portions projecting into the cavity; and a shielding shell surrounding the housing and comprising a pair of side walls covering on the side walls of the insulating housing;

wherein each of the side walls of the shielding shell defines a resilient arm extending into the mating cavity through the window portion.

2. The electrical connector as claimed in claim 1, wherein the sidewalls of the insulating housing are thickened in an inside thereof around the window portions.

3. The electrical connector as claimed in claim 2, wherein the resilient arm defines an arc portion projecting into the mating cavity and a free end bents outward to hide in the window portion;

wherein the insulating housing comprises a top wall connecting with the side walls and the shielding shell defines a top wall only covering a first portion of the top wall of the housing and flushing with the remaining second portion;

wherein the first portion of the shielding shell is defined at a rear half portion of the top wall of the insulating housing;

wherein the shielding shell defines a pair of locking portions in front of the top wall thereof to retain in corresponding slots defined at the top wall of the insulting housing;

wherein the locking portion comprises a retaining portion retained in the slot and a linking portion on the first portion of the top wall of the insulting housing and connecting the retaining portion with the side wall of the shielding shell; and wherein the slot comprising a first slot running though a rear face of the housing and a second slot deeper than the first slot to retain the retaining portion of the locking portion.

4. The electrical connector comprising:

an insulative housing including opposite top and bottom walls and opposite side walls commonly defining a receiving cavity communicating with an exterior through a front face on the housing;

a plurality of contacts disposed in the housing with contacting sections extending into the receiving cavity;

a metallic shell covering said housing;

each of said side walls defining a boss portion surrounding an interior face with a window therein, said window defining an arc portion closer to the front face; and the shell defining a pair of openings corresponding to the windows, respectively, having an arc section closer to the front face; wherein said shell unitarily includes a pair of spring arms in the corresponding openings and extending into the corresponding windows, respectively, under condition that each of said arms defines an arc head in compliance with the corresponding arc section;

wherein the metallic shell defines a pair of locking portions in front of the top wall thereof to retain in corresponding slots defined at the top wall of the insulting housing;

wherein the locking portion comprises a retaining portion retained in the slot and a linking portion on the first portion of the top wall of the insulting housing and connecting the retaining portion with the side wall of the shielding shell; and wherein the slot comprising a first slot running though a rear face of the housing and a second slot deeper than the first slot to retain the retaining portion of the locking portion.

* * * * *